US005475394A

United States Patent [19]

Kohls et al.

[11] Patent Number: 5,475,394

[45] Date of Patent: Dec. 12, 1995

[54] WAVEGUIDE TRANSITION FOR FLAT PLATE ANTENNA

[75] Inventors: Eric C. Kohls, Bethesda; Robert M. Sorbello, Potomac; Bernard D. Geller, Rockville; Francois T. Assal, Bethesda, all of Md.

[73] Assignee: Comsat Corporation, Bethesda, Md.

[21] Appl. No.: 292,167

[22] Filed: Aug. 18, 1994

Related U.S. Application Data

[63] Continuation of Ser. No. 648,459, Jan. 30, 1991, abandoned.

[51] Int. Cl.[6] ..... H01Q 1/38

[52] U.S. Cl. ..... 343/700 MS; 343/846

[58] Field of Search ..... 343/700 MS, 762, 343/771, 830, 846, 848, 851, 778, 814; 333/26, 33

[56] References Cited

U.S. PATENT DOCUMENTS

| | | | |
|---|---|---|---|
| 2,907,033 | 10/1956 | Brown | 343/762 |
| 3,887,925 | 6/1975 | Ranghelli et al. | 343/795 |
| 4,376,938 | 3/1983 | Toth et al. | 343/700 MS |
| 4,651,159 | 3/1987 | Ness | 343/700 MS |
| 4,761,654 | 8/1988 | Zaghlouh | 343/700 MS |
| 4,835,540 | 5/1989 | Haruyama et al. | 343/700 MS |
| 4,999,592 | 3/1991 | Kanda et al. | 333/33 |
| 5,005,019 | 4/1991 | Zaghlouh et al. | 343/700 MS |

FOREIGN PATENT DOCUMENTS

| | | | |
|---|---|---|---|
| 0028705 | 2/1984 | Japan | 343/772 |
| 0177603 | 7/1990 | Japan | 343/700 MS |
| 1008825 | 3/1983 | U.S.S.R. | 343/700 MS |
| 2194101 | 2/1988 | United Kingdom . | |

OTHER PUBLICATIONS

Koichi Ito et al., "Planar antenna for satellite reception", IEEE, vol. 34, No. 4, Dec. 1988, pp. 457–464.

*Primary Examiner*—Donald T. Hajec
*Assistant Examiner*—Tan Ho
*Attorney, Agent, or Firm*—Sughrue, Mion, Zinn, Macpeak & Seas

[57] ABSTRACT

In a flat plate antenna, insertion loss is reduced significantly by providing an extensive waveguide structure at the back of the ground plane of the antenna. Depending on antenna size, the waveguide may feed the antenna at one or a plurality of points. According to a preferred embodiment, the transition from waveguide to stripline is made via a coaxial connection, with a quarter-wave transformation, including mode suppression walls to direct the energy more efficiently. Alternatively, a direct waveguide to stripline transition may be provided. The technique has wide applicability to a number of antenna designs, including single- and dual-polarization structures, and linear and circular polarization operation.

11 Claims, 6 Drawing Sheets

WAVEGUIDE TRANSITION FOR FLAT PLATE ANTENNA

This is a Continuation of application Ser. No. 07/648,459 filed Jan. 30, 1991, now abandoned.

BACKGROUND OF THE INVENTION

The present invention is another of a series of improvements stemming from an initial development by the assignee of this application, in the area of flat antennae. That initial development, disclosed and-claimed in U.S. Pat. No. 4,761,654, relates to a flat plate or printed circuit antenna in which all of the elements, including the ground plane, feedline, feeding patches, and radiating patches, are capacitively coupled to each other. The inventive structure enables either linear or circular polarization. A continuation-in-part of that application, application Ser. No. 06/930,187, now U.S. Pat. No. 5,005,019 discloses and claims slot-shaped elements. The disclosures of these patents are hereby incorporated herein by reference.

Previously, in such flat plate antennae, it has been known to provide input power to the array at a single feedpoint, and then to use a printed line, such as stripline, to carry power through a power divider network (PDN) to the various elements of the array. However, for large arrays, such as those which are perhaps one meter wide, using a printed distribution line results in unacceptably high losses. It would be desirable to minimize these losses.

Another copending, commonly assigned application, Ser. No. 07/210,433, discloses two improvements, including the incorporation of a low noise block (LNB) down-converter into the power divider structure, at a sacrifice of array elements. Another improvement disclosed therein is the use of coplanar waveguide technology to provide a power connection to the feedpoint of the array. The remainder of the feeding to the elements of the array is done in stripline, or another type of technology such as microstrip, finline, or slotline. The disclosure of that copending application also is incorporated herein by reference.

The limited use of the waveguide structure, and the resulting extensive use of etched power distribution lines in the antenna results in undesirably high loss.

SUMMARY OF THE INVENTION

In view of the foregoing, it is a primary object of the invention to provide a feed structure for a flat plate antenna which results in lower loss and thus in improved performance.

To achieve the foregoing and other objects and advantages, the invention disclosed herein provides a flat plate antenna with a feed structure partially implemented in waveguide, rather than using only a printed distribution line. The array is fed at a single point, using a coaxial connection through the ground plane. Waveguide structure is attached to the back of the ground plane, using the ground plane itself as a top wall for the waveguide.

For arrays of relatively small size, the waveguide structure is incorporated to provide feeding to a limited number of points in the array, whereupon a printed distribution line is used. However, for larger arrays, where losses become greater because of the greatly increased amount of printed distribution line which would be necessary, a more extensive waveguide structure is provided, with a plurality of transition points in different quadrants of the array.

Because the invention is directed solely to the power feed structure for a flat plate antenna, implementation of the invention need not be restricted to a particular type of radiating element. Rather, radiating elements such as those disclosed in U.S. Pat. No. 4,761,654 and U.S. Pat. No. 5,005,019 may be used. Further, the invention is applicable not only to single-polarization implementations such as those just mentioned, but also is applicable to a dual-polarization structure, such as that disclosed in U.S. Pat. No. 07/165,332, now U.S. Pat. No. 4,929,959, and U.S. Pat. No. 07/192,100, now U.S. Pat. No. 4,926,189. This last U.S. patent also discloses another type of radiating element, which also may be used with the present invention. The disclosures of these patents also is incorporated herein by reference.

Further, implementation of the invention would not be hindered if structure such as that shown in copending application Ser. No. 07/210,433 were to be used. Thus, it can be seen that the invention has wide applicability to a number of structures and technologies in the flat plate antenna area.

BRIEF DESCRIPTION OF THE DRAWINGS

The foregoing and other features and advantages of the invention will be more readily apparent from the following description taken in conjunction with the accompanying drawings, in which.

DETAILED DESCRIPTION OF THE PREFERRED EMBODIMENTS

Figure 1:
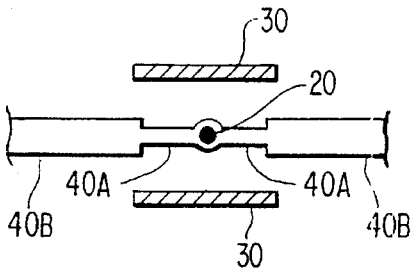
FIG. 1 shows a plan view of feed structure incorporating the invention.

As seen in FIG. 1, power divider network layer 15 of a flat plate antenna is fed via a central feeding location 20 which, in the disclosed embodiment, is a waveguide input to a waveguide-E-plane bend. The E-plane bend structure is shown in greater detail in FIGS. 2B and 2C, and will be discussed below. In the present embodiment, a coaxial probe transition is provided. The connection 20 feeds the layer 15 at a single feedpoint, through a hole drilled in the ground plane 10. The single feedpoint implementation is essentially the same as that described in copending application Ser. No. 07/210,433. The coaxial connection 20 feeds a quarter-wave transition portion 40A, to a printed distribution network 40B on power divider network layer 15.

The probe 20 itself is optimized in length, and tuned to a desired frequency. At the feedpoint there is a quarter wave transformation 40A to stripline 40B. Mode suppression walls 30, parallel to each other and provided on opposite sides of the coaxial feed 20, are provided for impedance matching purposes, and to facilitate the transition from waveguide to stripline.

One wall of the waveguide 100 (FIGS. 2A, 2B, and 3) is formed by the ground plane 10 itself. The other three walls of the waveguide 100 may be either a cast metal piece or metallized plastic, attached to the back of the ground plane 10. The waveguide itself is a well-known type of rectangular waveguide, so that the inner dimension is rectangular.

Figure 2A:
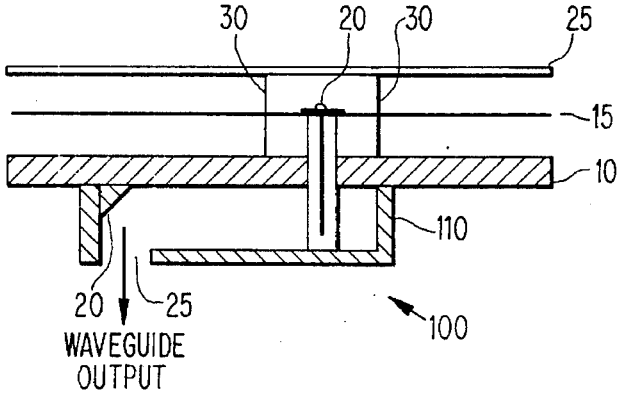
FIGS. 2A and 2B show transverse cross-sectional views of the structure of FIG. 1 in a flat antenna.

In FIG. 2A, a wedge or metal plate 120 is provided at an opposite end of the waveguide from the probe 20, at a 45° angle to the direction of propagation of the waveguide output, and opposite a waveguide opening 125. The purpose of the wedge is to bend, at a 90° angle, the propagation path of the waveguide output.

As mentioned above, the length of the probe is optimized so as to be tunable to the desired frequency. Also, the match into the waveguide can be tuned by providing the end wall 110 of the waveguide 100 an appropriate distance d from the probe. Thus, the probe function are optimized by tuning in this fashion, and also by providing the mode suppression walls 30 in a vertical plane at the initial connection point and running along the power divider network of the array, to suppress the unwanted parallel plate mode. Without the mode suppression walls 30, energy can propagate out the sides, and provide inefficient coupling into the power divider. These vertical walls run the full height between the stripline and the ground plane, providing a type of suspended substrate at the initial transition point, and thus effectively provide four walls that completely surround the connection. Preferably, the mode suppression walls 30 are a distance on the order of $\lambda/4$ from the coaxial probe 20, and are on the order of $\lambda/2$ long, where $\lambda$ is the wavelength of the radiation of interest.

The quarter wave transformation mentioned above matches the waveguide into the power divider network. For example, in the presently known implementation, the coaxial feed is approximately 50 ohms, and is matched into a 70 ohm impedance.

Figure 2B:
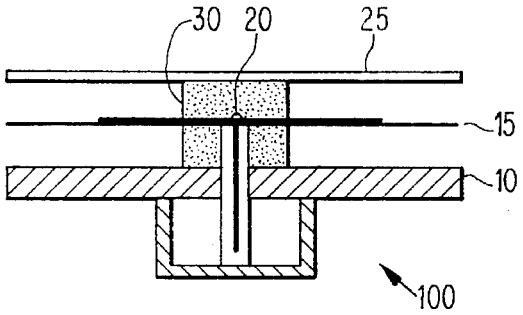
Figure 2C:
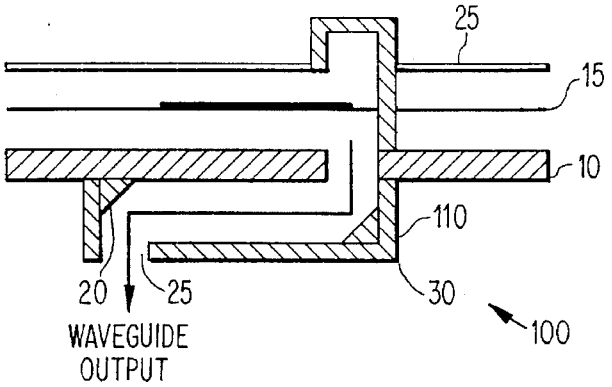
FIG. 2C shows an alternative implementation of the transition structure of FIG. 1.

An alternative feed structure, using a direct waveguide/stripline transition, is shown in FIG. 2C. In this implementation, a second wedge or metal plate 130 is provided in lieu of the probe 20. The waveguide extends through the ground plane 10, the power divider network layer 15, and the radiating element layer 25, as shown, directly to the stripline. Because of the two wedges 120, 130, there are two E-plane bends in the propagation path, as shown by the arrow. Tuning of this structure is effected by adjusting the extent of waveguide penetration through the ground plane, and also by adjusting the distance that the stripline extends into the waveguide.

Figure 3:
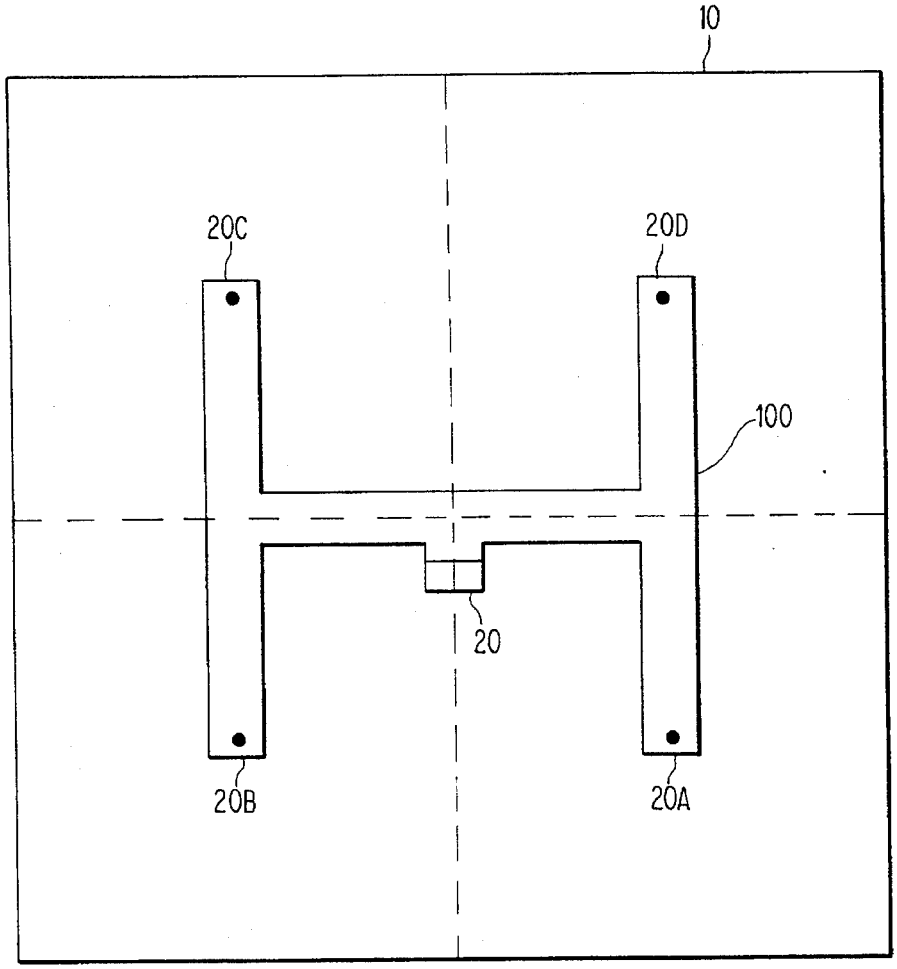
FIG. 3 shows an implementation of the structure of FIG. 1 in a multi-quadrant implementation, from the underside of the antenna.
Figure 8:
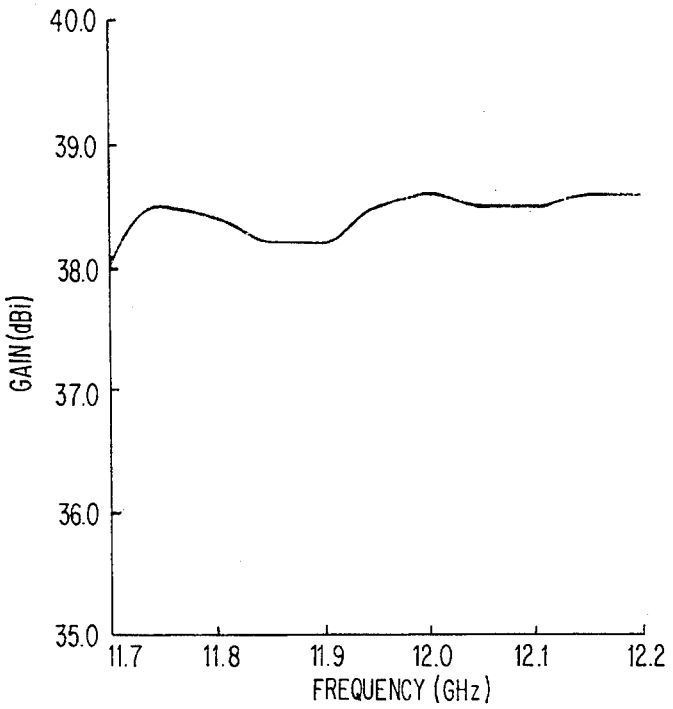
Figure 9:
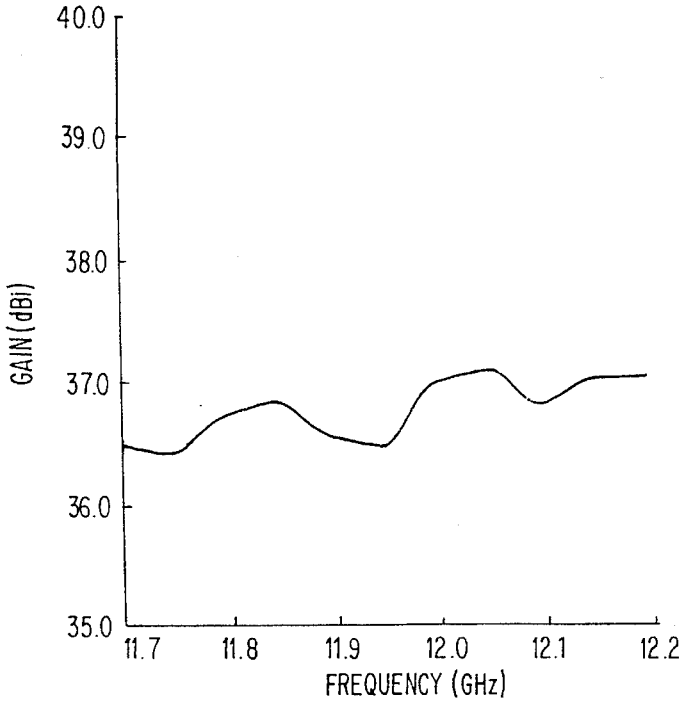

For a large structure, as shown in FIG. 3, the array may be divided into four quadrants, with a feedpoint 20A–20D in the center of each quadrant, and the central feeding location 20 as shown in FIG. 1. At each feedpoint 20A–20D, mode suppression walls 30 and quarterwave transitions 40A to stripline 40B are provided. A waveguide network 100 is provided on the back of the array, beneath the ground plane 10, the ground plane 10 itself acting as a top wall for the waveguide, as mentioned earlier. Because of the low loss of the waveguide structure, the overall efficiency of the array is substantially better than that of an array using only a printed power distribution line. FIGS. 8 and 9, for example, show comparative results between an antenna using the inventive feeding technique (FIG. 8) and an antenna using a conventional feeding technique (FIG. 9). The inventive antenna is 1.5 to 2.0 dB better across the bandwidth of interest.

Naturally, there is some trade-off between the cost of implementing waveguide and the gain in efficiency. This is why for a larger array, which would require a correspondingly larger power distribution network and thus correspondingly larger losses, it is desirable to have waveguide implemented more extensively on the back of the ground plane. Larger arrays essentially are divided into quadrants, with the waveguide being provided as a feed to each of the quadrants.

Losses in the power distribution network degrade the signal in two different ways. First, the gain or the power of the signal is decreased, thus lowering the signal to noise (S/N) ratio. In addition to attenuating the signal level, the loss adds random noise to the signal, thus increasing the denominator of the S/N ratio.

The implications may be considered as follows. For example, for these types of antennae, the distance from the central feeding location to the outer elements is approximately equal to the length of one side of the array. Thus, for an antenna that is one foot square, the distance from the output to a particular element is approximately one foot. For distances of this length, the loss is not appreciable, but for distances as large as a meter (i.e., for arrays that are one meter square), the loss does become significant, thereby making it advisable to provide the waveguide transition.

By substituting the higher-loss printed line with the waveguide, especially for larger arrays, total loss being a function of the total length from the output to the element, both of the aspects of degradation of the S/N ratio discussed above are compensated.

The single-feed structure for a smaller array yields a single feed configuration, as seen for example in FIG. 1, and FIGS. 2A and 2B. For a multi-quadrant structure such as shown in FIG. 3, essentially there are three Ts. At the ends of the last two Ts, there are feeds and transitions from waveguide to stripline.

FIGS. 2A and 2B show a cross-sectional view of the flat pate antenna for a single-polarization structure, including a radiating element layer 25. It should be noted, as discussed in the above-mentioned patents, that the radiating elements in layer 25 are impedance matched with the feedlines in power divider network layer 15. Those feedlines may have any of the shapes disclosed in the above-mentioned patents.

The preferred height of the mode suppression walls 30 is equal to the full height between the ground plane 10 and the radiating element layer 25, extending through the power divider network layer 15.

Figure 4:
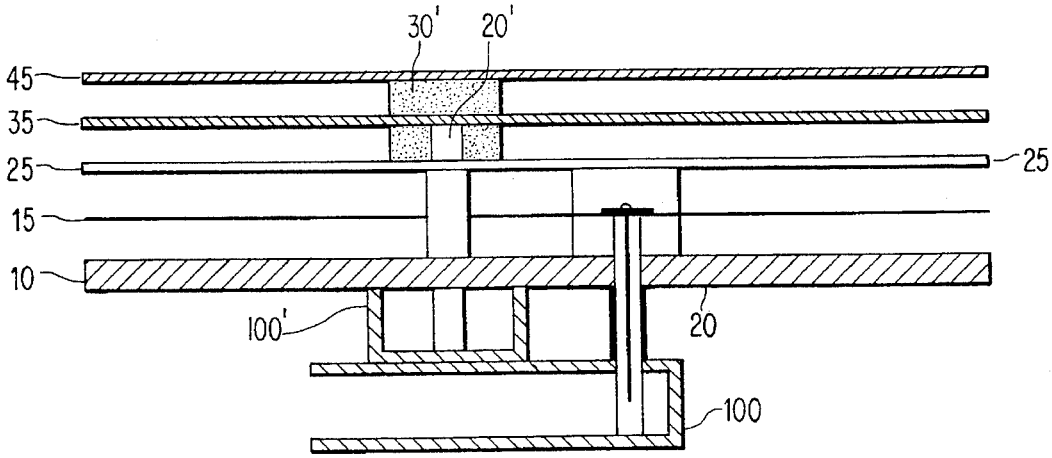
FIG. 4 shows a cross-sectional view of a dual-polarization antenna showing the inventive waveguide feed structure.

A dual-polarization structure also is possible, as shown in FIG. 4. Such a structure includes an additional power divider network 35 overlying the radiating element layer 25, and an additional radiating element layer 45 overlying the top power divider network 35. The radiating element layer 25 acts as a ground plane for the overlaid structure. The elements in layer 25 are disposed orthogonally with respect to those in layer 45 There are two waveguide structures 100 and 100', also disposed orthogonally with respect to each other, and two coax probes 20, 20'. Mode suppression walls 30 extend between ground plane 10 and radiating element layer 25, and mode suppression walls 30' extend between the layer 25 and the upper radiating element layer 45.

Figure 5:
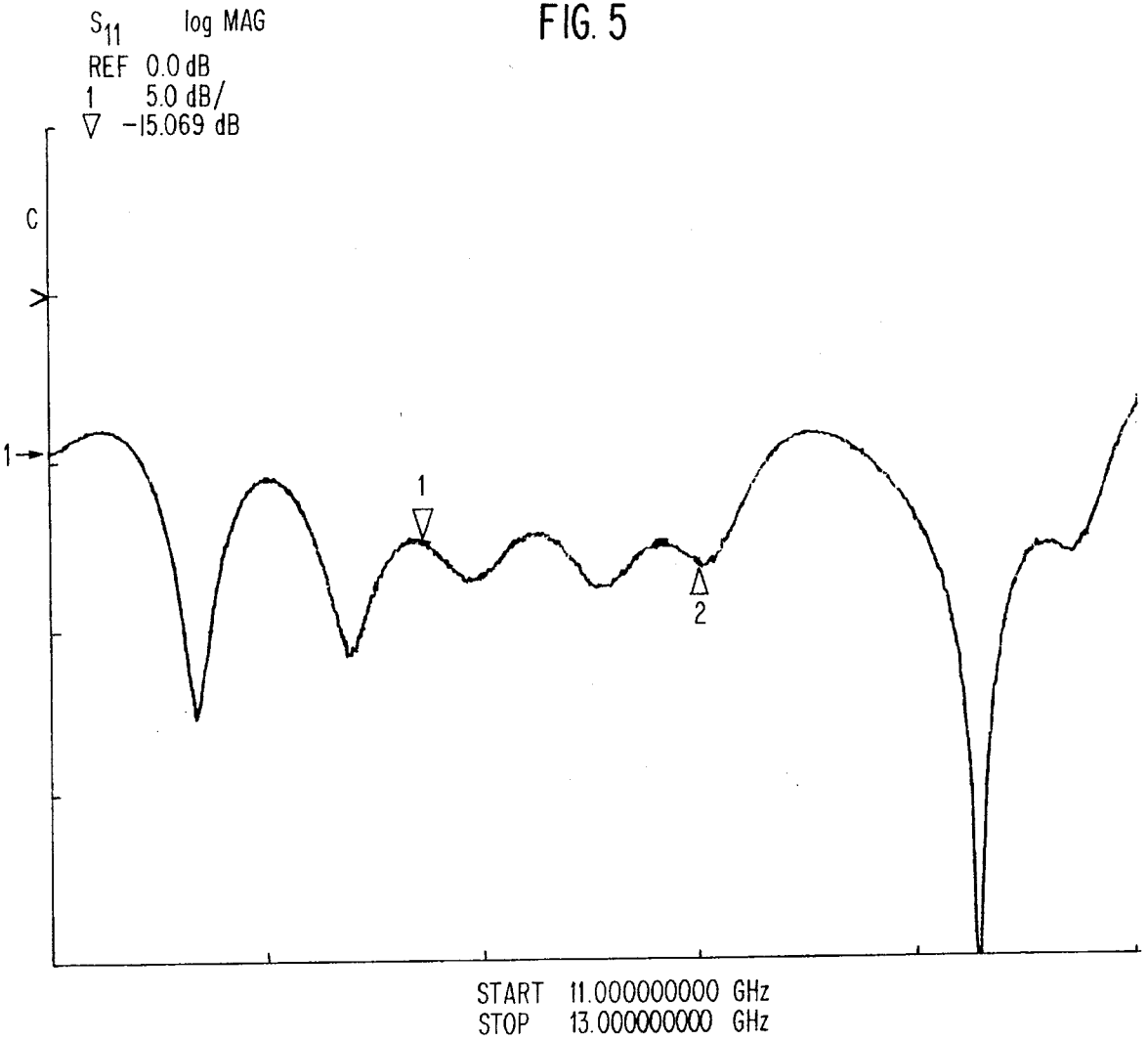
FIGS. 5–9 show graphs of results attained with the inventive structure, in a single-quadrant and multi-quadrant implementation.
Figure 6:
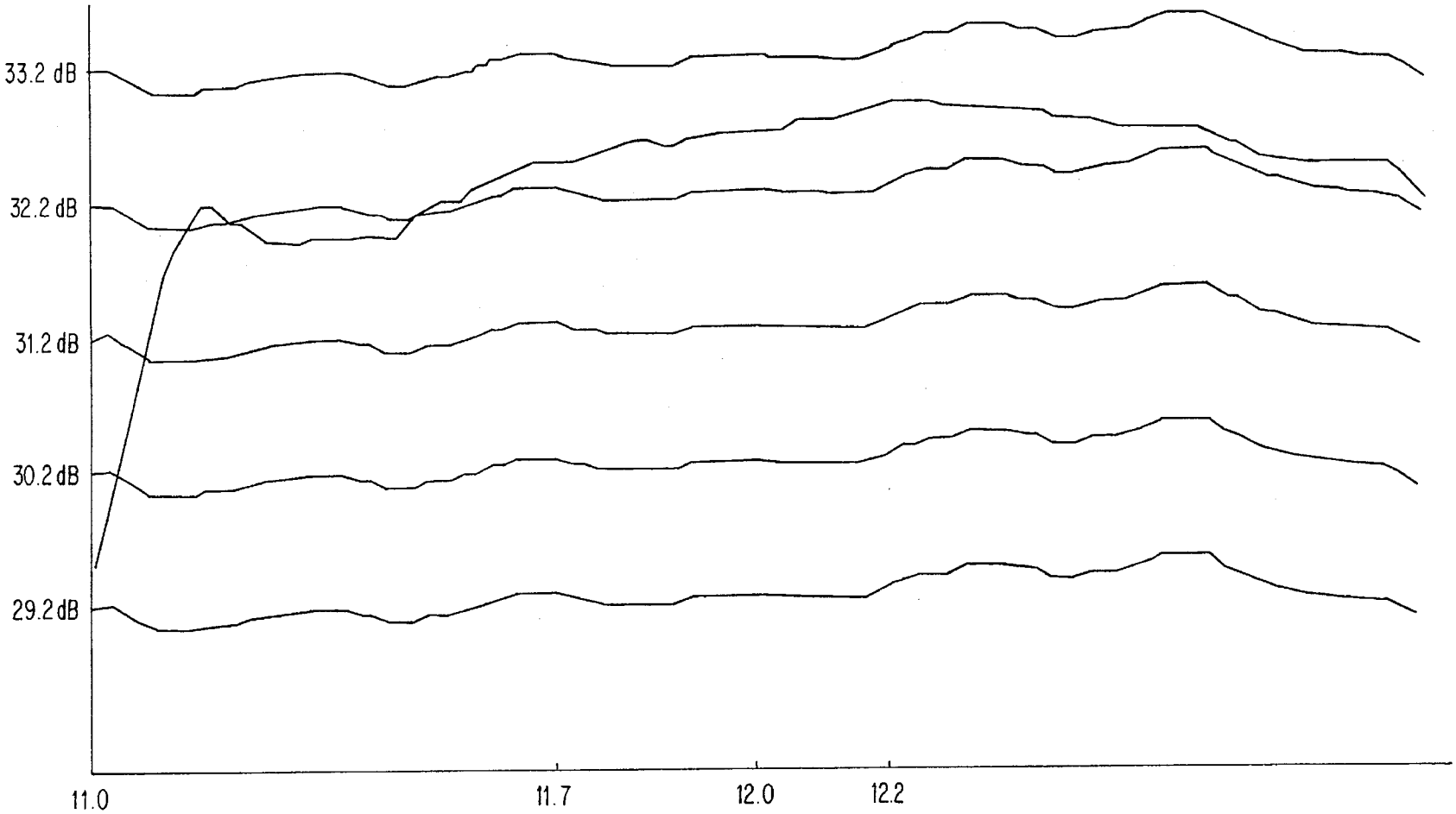

Comparative results showing the performance of the array using waveguide relative to results attained using conventional stripline are shown in FIGS. 5–9. FIGS. 5 and 6 show return loss and gain results for a single-quadrant (256-element) implementation. As can be seen from these Figures, single-probe feeding provides very good input return loss with a corresponding high aperture efficiency (85–90%) for small apertures (on the order of $10\lambda$ to $15\lambda$).

Figure 7:
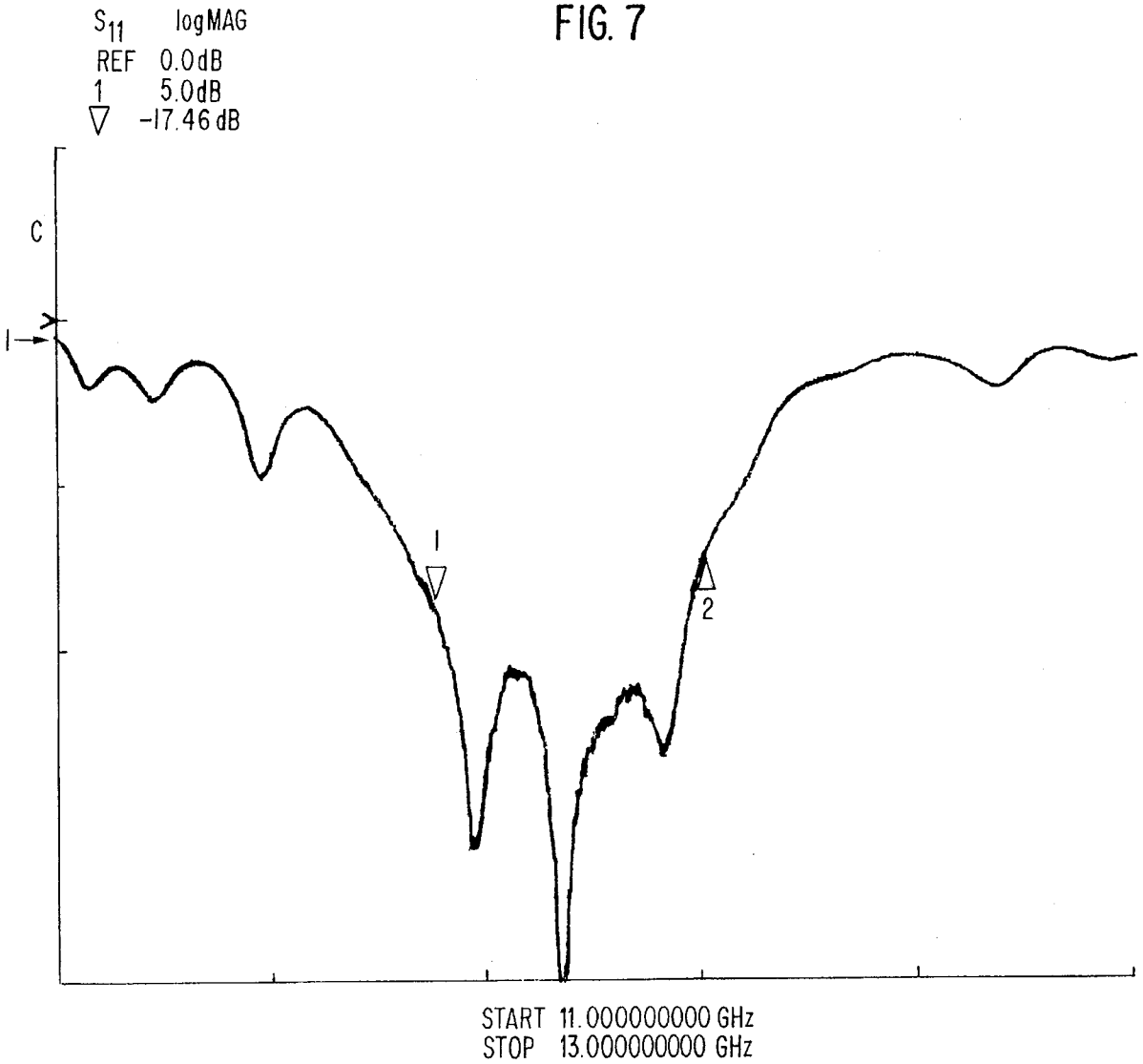

Waveguide integration is employed to maintain the single-probe efficiency for larger apertures (20λ to 30λ). FIGS. 7 and 8 show results for a multi-quadrant (1024-element) implementation. As can be seen, the input return loss is of the same order as for the single-probe implementation, and the swept gain is very near the ideal 6 dB increase, corresponding to an aperture efficiency of 80–85%.

The results in FIGS. 7 and 8 may be contrasted with those of FIG. 9, for a conventional 1024-element structure that employs an all-stripline power distribution network. FIG. 9 shows swept gain 1.5 to 2.0 dB lower than that of the inventive antenna, corresponding to only a 50–60% aperture efficiency.

As mentioned above, the power feed structure of the invention is applicable to flat plate antennas using a variety of types of radiating elements, such as those shown in the just-mentioned U.S. patents and copending applications. Thus, the inventive feed technique finds application not only in single- and dual-polarization implementations, but also to both linear and circular polarization implementations are contemplated. Still further, while stripline is the presently-preferred implementation of the power distribution network for receiving the transition from waveguide, other structures, including finline, slotline, and microstrip are within the contemplation of the invention.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. A flat plate antenna comprising:

a ground plane;

a power distribution network layer disposed over said ground plane, said power distribution network layer comprising a central feed location, at least two power distribution lines radiating from said central feed location, and a plurality of feedlines radiating from said at least two power distribution lines;

a radiating element layer capacitively coupled to said power distribution network layer, said radiating element layer comprising a plurality of radiating elements in one-to-one correspondence with and impedance matched with said plurality of feedlines; and a waveguide, fastened to a side of said ground plane opposite said power distribution network layer, for feeding power to said power distribution network layer at said central feed location, said ground plane forming one wall of said waveguide, wherein said central feed location comprises E-plane bend means, disposed within said waveguide, for bending a propagation path of an output of said waveguide.

2. A flat plate antenna as claimed in claim 1, said waveguide comprising a cast metal structure having a rectangular inner cavity.

3. A flat plate antenna as claimed in claim 1, said waveguide comprising a metallized plastic structure having a rectangular inner cavity.

4. A flat plate antenna as claimed in claim 1, wherein said power distribution network layer comprises a stripline distribution network.

5. A flat plate antenna as claimed in claim 1, wherein said power distribution network layer comprises a microstrip distribution network.

6. A flat plate antenna as claimed in claim 1, wherein said power distribution network layer comprises a slotline distribution network.

7. A flat plate antenna as claimed in claim 1, wherein said power distribution network layer comprises a finline distribution network.

8. A flat plate antenna as claimed in claim 1, wherein said radiating elements comprise elements having perturbation segments extending therefrom, each of said elements being fed at a single point, so as to achieve circular polarization.

9. A flat plate antenna comprising:

a ground plane;

a Power distribution network layer disposed over to said ground plane, said power distribution network layer comprising a central feed location, at least two power distribution lines radiating from said central feed location, and a plurality of feedlines radiating from said at least two power distribution lines;

a radiating element layer capacitively coupled to said power distribution network layer, said radiating element layer comprising a plurality of radiating elements in one-to-one correspondence with and impedance matched with said plurality of feedlines; and a waveguide, fastened to a side of said ground plane opposite said power distribution network layer, for feeding power to said power distribution network layer at said central feed location;

wherein said central feed location comprises E-plane bend means, disposed within said waveguide, for bending a propagation path of an output of said waveguide, said waveguide extending through said ground plane and being impedance matched to said power distribution lines on said power distribution network layer.

10. A flat plate antenna comprising:

a ground plane;

a stripline power distribution network layer divided into four quadrants and disposed over said ground plane, said stripline power distribution network layer comprising a central feed location, four feedpoints, one in each of said quadrants, connected to said central feed location, at least two power distribution lines radiating from each of said feedpoints, and a plurality of feedlines radiating from said at least two power distribution lines;

a radiating element layer capacitively coupled to said stripline power distribution network layer, said radiating element layer comprising a plurality of radiating elements in one-to-one correspondence with and impedance matched with said plurality of feedlines; and a waveguide, fastened to a side of said ground plane opposite said stripline power distribution network layer, for feeding power to said power distribution network layer at said central feed location, said ground plane forming one wall of said waveguide, said waveguide feeding power to said stripline power distribution network layer at each of said feedpoints;

wherein each of said feedpoints comprises a coaxial connection, and a pair of mode suppression walls on either side of said coaxial connection and extending through said power distribution network layer, each said coaxial connection being impedance matched to said power distribution lines on said stripline power distribution network layer;

wherein each of said feedpoints comprises E-plane bend means, disposed within said waveguide, for bending a propagation path of an output of said waveguide, said waveguide extending through said ground plane and being impedance matched to said power distribution lines on said power distribution network layer, said four feedpoints being capacitively connected to said central feed location.

11. A flat plate antenna comprising:

a ground plane;

a first stripline power distribution network layer divided into four quadrants and disposed over to said ground plane, said first stripline power distribution network layer comprising a first central feed location and first through fourth feedpoints, one in each of said quadrants, connected to said first central feed location, at least two power distribution lines radiating from each of said first to fourth feedpoints, and a first plurality of feedlines radiating from said at least two power distribution lines;

a first radiating element layer capacitively coupled to said first stripline power distribution network layer, said first radiating element layer comprising a plurality of radiating elements in one-to-one correspondence with and impedance matched with said first plurality of feedlines;

a first waveguide, disposed on a side of said ground plane opposite said first stripline power distribution network layer, said first waveguide feeding power to said first power distribution network layer at each of said first through fourth feedpoints, each of said first through fourth feedpoints comprising a coaxial connection, and a pair of mode suppression walls on either side of each said coaxial connection, each said coaxial connection being impedance matched to said power distribution lines on said first stripline power distribution network layer;

a second stripline power distribution network layer divided into four quadrants and capacitively coupled to said first radiating element layer, said second stripline power distribution network layer comprising a second central feed location and fifth through eighth feedpoints, one in each of said quadrants, connected to said second central feed location, at least two power distribution lines radiating from each of said fifth through eighth feedpoints, and a second plurality of feedlines radiating from said at least two power distribution line;

a second radiating element layer capacitively coupled to said second stripline power distribution network layer, said second radiating element layer comprising a plurality of radiating elements in one-to-one correspondence with and impedance matched with said second plurality of feedlines; and a second waveguide, fastened to a side of said ground plane opposite said first stripline power distribution network layer between said ground plane and said first waveguide, and disposed orthogonally to said first waveguide, said ground plane forming one wall of said second waveguide, said second waveguide feeding power to said second power distribution network layer at each of said fifth through eighth feedpoints, each of said fifth through eighth feedpoints comprising a coaxial connection, and a pair of mode suppression walls on either side of said coaxial connection, said coaxial connection being impedance matched to said power distribution lines on said first stripline power distribution network layer.

* * * * *